US010829722B2

(12) United States Patent
DeGroot et al.

(10) Patent No.: US 10,829,722 B2
(45) Date of Patent: Nov. 10, 2020

(54) AZEOTROPE-LIKE COMPOSITION

(71) Applicant: ENVIRO TECH INTERNATIONAL, INC., Melrose Park, IL (US)

(72) Inventors: Richard J. DeGroot, Riverview, MI (US); Karl Loepke, Melrose Park, IL (US); Andrew Mavec, Melrose Park, IL (US)

(73) Assignee: ENVIRO TECH INTERNATIONAL, INC., Melrose Park, IL (US)

( * ) Notice: Subject to any disclaimer, the term of this patent is extended or adjusted under 35 U.S.C. 154(b) by 0 days.

(21) Appl. No.: 16/470,684

(22) PCT Filed: Dec. 21, 2017

(86) PCT No.: PCT/US2017/067803
§ 371 (c)(1),
(2) Date: Jun. 18, 2019

(87) PCT Pub. No.: WO2018/125738
PCT Pub. Date: Jul. 5, 2018

(65) Prior Publication Data

US 2019/0338223 A1 Nov. 7, 2019

Related U.S. Application Data

(60) Provisional application No. 62/439,708, filed on Dec. 28, 2016.

(51) Int. Cl.
*C11D 7/50* (2006.01)
*C11D 7/24* (2006.01)
(Continued)

(52) U.S. Cl.
CPC ..... *C11D 7/5063* (2013.01); *C11D 7/245* (2013.01); *C11D 7/261* (2013.01); *C11D 7/30* (2013.01);
(Continued)

(58) Field of Classification Search
CPC ..... C11D 7/5018; C11D 7/30; C11D 7/50
(Continued)

(56) References Cited

U.S. PATENT DOCUMENTS 5,478,492 A 12/1995 Barthelemy et al.
7,053,035 B2 5/2006 Hanada et al.
(Continued)

FOREIGN PATENT DOCUMENTS

EP 2 746 380 A1 6/2014
EP 3 012 318 4/2016
WO WO-2008/095879 8/2008

OTHER PUBLICATIONS

International Preliminary Report on Patentability and Written Opinion of the International Searching Authority in International Application No. PCT/US2017/067803, dated Jul. 2, 2019 (7 pages).
(Continued)

*Primary Examiner* — Gregory E Webb
(74) *Attorney, Agent, or Firm* — Marshall, Gerstein & Borun LLP

(57) ABSTRACT

Disclosed herein are multi-component, azeotrope-like compositions containing trans-dichloroethylene, 1,1,1,3,3-pentafluorobutane, and 1,1,2,2-tetrafluoroethyl-2,2,2-trifluoroethyl ether. These compositions also form an azeotrope-like mixture with methanol. These compositions are useful as solvents in refrigeration flushing, oxygen system cleaning, foam blowing, and cleaning operations such as cold cleaning, vapor degreasing, and aerosol cleaners.

12 Claims, 7 Drawing Sheets

(51) Int. Cl.
*C11D 7/26* (2006.01)
*C11D 7/30* (2006.01)

(52) U.S. Cl.
CPC ..... *C11D 7/5054* (2013.01); *C11D 7/5072* (2013.01); *C11D 7/5081* (2013.01)

(58) Field of Classification Search
USPC ..... 510/407, 505
See application file for complete search history.

(56) References Cited

U.S. PATENT DOCUMENTS

| | | | | |
|---|---|---|---|---|
| 7,163,645 | B2 | 1/2007 | Hanada et al. | |
| 7,189,339 | B2 | 3/2007 | Dournel et al. | |
| 7,527,697 | B2 | 5/2009 | Tsuzaki et al. | |
| 8,877,087 | B2 | 11/2014 | Marhold et al. | |
| 2003/0224956 | A1* | 12/2003 | Miller | C11D 7/261 510/175 |
| 2004/0013610 | A1 | 1/2004 | Dournel | |
| 2013/0079267 | A1 | 3/2013 | Marhold et al. | |
| 2013/0244922 | A1 | 9/2013 | Bartelt et al. | |
| 2015/0037505 | A1 | 2/2015 | Tsuzaki et al. | |
| 2015/0240089 | A1 | 8/2015 | Mitsuoka et al. | |
| 2015/0315531 | A1 | 11/2015 | Uenveren et al. | |
| 2019/0241843 | A1* | 8/2019 | Shellef | C11D 7/5036 |

OTHER PUBLICATIONS

International Search Report and Written Opinion for Application No. PCT/US2017/067803, dated Mar. 9, 2018.

* cited by examiner

AZEOTROPE-LIKE COMPOSITION

CROSS REFERENCE TO RELATED APPLICATION

Priority is claimed to U.S. provisional patent application No. 62/439,708, filed Dec. 28, 2016, the disclosure of which is incorporated herein by reference in its entirety.

BACKGROUND

Field of the Disclosure

The invention relates to multi-component, azeotrope-like compositions containing 1,2-trans-dichloroethylene, 1,1,1,3,3-pentafluorobutane, 1,1,2,2-tetrafluoroethyl-2,2,2-trifluoroethyl ether. These compositions also form an azeotrope-like mixture with methanol. These compositions are useful as solvents in refrigeration flushing, oxygen system cleaning, foam blowing, and cleaning operations such as cold cleaning, vapor degreasing, and aerosol cleaners.

Brief Description of Related Technology

Solvents have widespread use in the cleaning industry, i.e. vapor degreasing, cold cleaning and ultrasonic cleaning of complex metal parts, circuit boards, electronic components, implantable prosthetic devices, optical equipment and others.

Vapor degreasing involves exposing a room temperature object to be cleaned to vapors of a boiling solvent. Vapors condensing on the object provide clean distilled solvent to wash away grease or other contaminants. Final evaporation of the solvent from the object leaves no residue on the object.

A vapor degreaser is useful to remove difficult-to-remove soils where elevated temperature is necessary to improve the cleaning action of the solvent. A vapor degreaser also is useful for large volume assembly line operations where the cleaning of metal parts and assemblies must be done efficiently. The conventional operation of a vapor degreaser includes immersing the part to be cleaned in a sump of boiling solvent that removes the bulk of the soil, thereafter immersing the part in a sump containing freshly distilled solvent near room temperature, and finally exposing the part to solvent vapors over the boiling sump that condense on the cleaned part. The part can also be sprayed with distilled solvent before final rinsing.

Azeotrope-like compositions are particularly desired for vapor degreasing because they maintain a near constant composition upon boiling. This behavior is desirable because in the previously described vapor degreasing equipment in which these solvents are used, redistilled material is generated for final rinse cleaning. Therefore, the vapor degreasing system acts as a still. Unless the solvent used exhibits an azeotrope-like property, the concentrations in the liquid and vapor phases will change over time and undesirable solvent distribution may occur and upset the cleaning efficiency and safety of the system.

The art is continually seeking new solvent mixtures that may offer alternatives for the above described applications. Examples include mixtures disclosed in U.S. Pat. Nos. 7,163,645 and 7,527,697, and European patent publication No. 2,746,380 A1. Currently, environmentally acceptable materials are of particular interest because the conventional fully-halogenated chlorocarbons and chlorofluorocarbons have been implicated in causing environmental problems associated with the depletion of the earth's protective ozone layer.

The art has also looked to compositions that include components contributing additional desired characteristics, such as polar functionality, increased solvency power, and stabilizers, while retaining those properties exhibited by the conventional chlorofluorocarbons including chemical stability, low toxicity, and non-flammability.

BRIEF DESCRIPTION OF THE FIGURES

For a more complete understanding of the disclosure, reference should be made to the following detailed description and accompanying drawings wherein.

Figure 1:
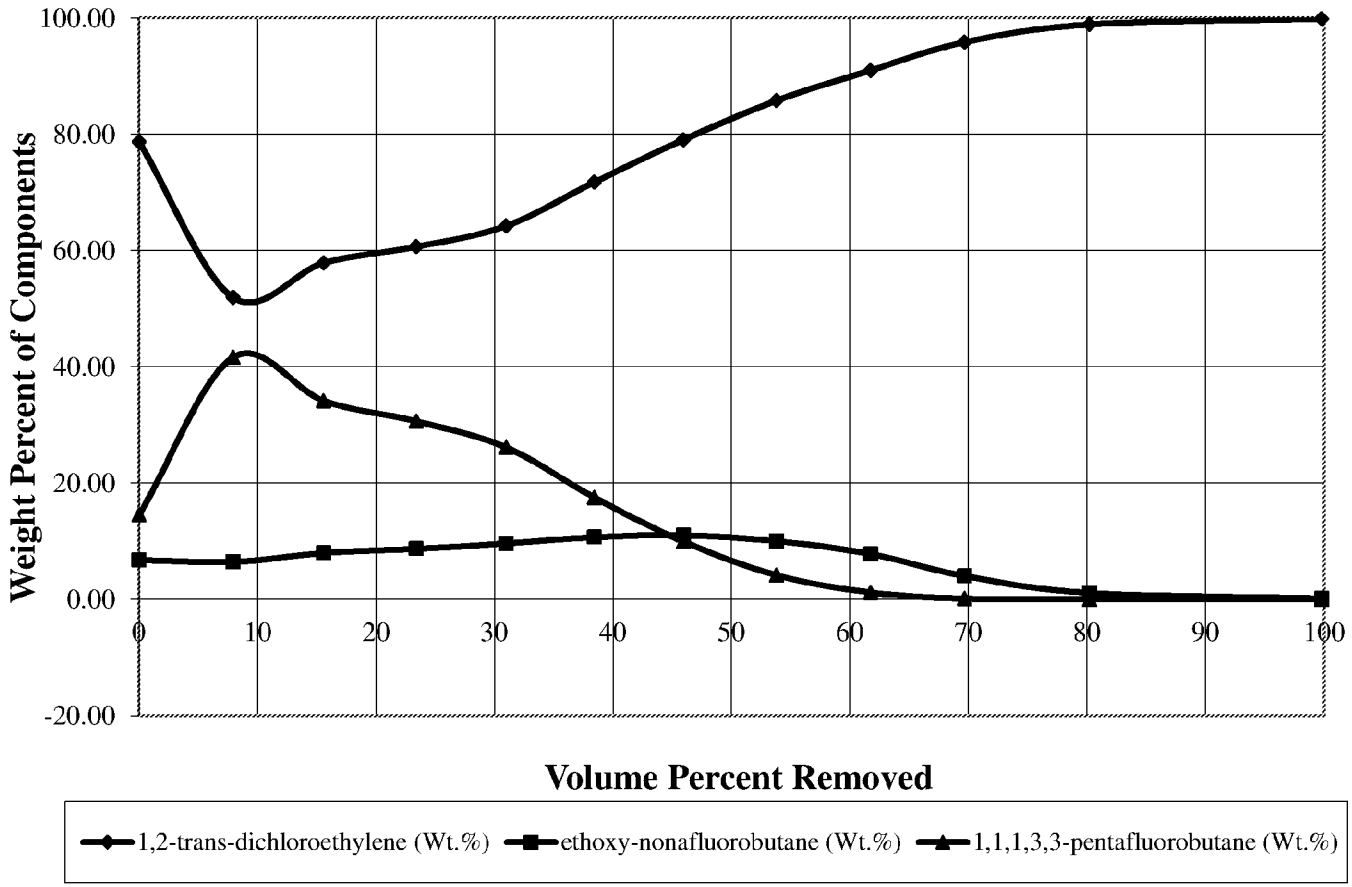
FIG. 1 is a plot of distillation cuts of a conventional, commercially-available formulation (not in accordance with the disclosed invention) and the concentrations of each of the formulation components in those cuts.

While the disclosed formulations are susceptible of embodiments in various forms, there are illustrated in the figures (and will hereafter be described) specific embodiments of the invention, with the understanding that the disclosure is intended to be illustrative, and is not intended to limit the invention to the specific embodiments described and illustrated herein.

DETAILED DESCRIPTION

It has now been found that 1,1,1,3,3-pentafluorobutane and 1,1,2,2-tetrafluoroethyl-2,2,2-trifluoroethyl ether are excellent molecules to mix with 1,2-trans-dichloroethylene. Their molecular structures together make them an effective solvent. An embodiment of the invention thus relates to azeotrope-like compositions containing amounts of 1,2-trans-dichloroethylene, 1,1,1,3,3 pentafluorobutane, and 1,1,2,2 tetrafluorethyl-2,2,2-trifluoroethyl ether effective to clean, for example, oils, greases, fluxes, and waxes off metal and electrical parts. Another embodiment of the invention relates to a mixture of these three compounds with a fourth component, a stabilizer, selected from the group consisting of alcohol, ether, ketone, alkane, alkene, and mixtures thereof. Suitable alcohols include methanol. Suitable alkanes include halogenated alkanes and cycloalkanes. Suitable alkenes include halogenated alkenes. These azeotrope-like compositions are effective as cleaning agents in, for example, vapor degreasers.

The 1,2-trans-dichloroethylene has a boiling point at 760 mm Hg of about 48° C. The 1,1,1,3,3 pentafluorobutane has a boiling point at 760 mm Hg of about 40° C. The 1,1,2,2 tetrafluorethyl-2,2,2-trifluoroethyl ether has a boiling point at 760 mm Hg of about 56.2° C.

If a single maximum or minimum temperature is reached relative to the individual components then, by definition, an azeotrope mixture exists. An azeotrope-like mixture is two or more substances that behave like a single substance when boiled, in that the vapor produced by partial evaporation of liquid has the same, or nearly the same, composition as the vapor at the stated temperature and pressure. In practice, therefore, the substances comprising the azeotrope-like mixture have a near constant boiling temperature.

The term azeotrope-like is referenced herein in describing the preferred mixtures of the invention because, in the claimed proportions, the components of the compositions (1,2-trans-dichloroethylene, 1,1,1,3,3 pentafluorobutane, and 1,1,2,2 tetrafluorethyl-2,2,2-trifluoroethyl ether) when combined with methanol also have a near constant boiling temperature. All compositions within the indicated ranges, as well as certain compositions outside the indicated ranges, are azeotrope-like as defined above.

One way to determine if a mixture is azeotrope-like is through fractional distillation. Fractional distillation columns are specifically designed to separate a mixture of liquids of components into pure components utilizing the differences in their boiling points. A fractional distillation column also can be used to determine the boiling point of the azeotrope-like mixture. If the mixture does not separate by fractional distillation it can be considered to be azeotrope-like. Analyzing the distilled fractions from a fractional distillation column can be useful to identify the concentrations of the azeotrope-like mixture.

It should be understood that the inventive compositions may include one or more additional components (such as stabilizers, inhibitors or antioxidants), some of which may form new azeotrope-like compositions. These components typically are added at the expense of 1,2-trans-dichloroethylene in amounts determinable by one skilled in the art. Typically these components are added with a maximum total concentration of less than 5 weight percent (wt. %), based on the total weight of the composition. Any such compositions are considered to be within the scope of the present invention so long as the mixture remains azeotrope-like, as explained above.

Stabilizers typically are added to solvent compositions to inhibit decomposition of the compositions; react with undesirable decomposition products of the compositions; and/or prevent corrosion of metal surfaces being cleaned. Any combination of conventional stabilizers known to be useful in stabilizing halogenated hydrocarbon solvents may be used. Suitable stabilizers include alkanols having 3 to 5 carbon atoms, nitroalkanes having 1 to 2 carbon atoms, 1,2-epoxyalkanes having 2 to 5 carbon atoms, ethers having 3 or 4 carbon atoms, unsaturated compounds having 4 to 6 carbon atoms, acetals having 4 to 7 carbon atoms, and aromatic antioxidants. A preferred alkanol is methanol, which has a boiling point at 760 mm Hg of about 64° C.

The following compositions were determined via fractional distillation to exhibit a constant boiling temperature at 760 mm Hg of about 34° C. to about 36° C. Specifically, a 60×2 cm mirrored-vacuum-jacketed distillation column packed with high efficiency random packing with a cold-water condensed automatic liquid dividing head was used to confirm the composition of azeotrope compositions. The distillation column was charged with the solvent mixture and the composition was heated under total reflux for about a half an hour to ensure equilibration. A reflux ratio of 3:1 was employed. The compositions of the overhead fractions were analyzed using Gas Chromatography.

Azeotrope-like Compositions A

Azeotrope-like compositions exhibiting the constant boiling point at 760 mm Hg of about 34° C. to about 36° C. generally include (a) about 37 wt. % to about 47 wt. % of 1,2-trans-dichloroethylene, (b) about 51 wt. % to about 61 wt. % of 1,1,1,3,3 pentafluorobutane, and (c) about 1 wt. % to about 8 wt % of 1,1,2,2 tetrafluorethyl-2,2,2-trifluoroethyl ether. Preferably these compositions include (a) about 40 wt. % to about 44 wt. % of 1,2-trans-dichloroethylene, (b) about 54 wt. % to about 57 wt. % of 1,1,1,3,3 pentafluorobutane, and (c) about 2 wt. % to about 6 wt. % of 1,1,2,2 tetrafluorethyl-2,2,2-trifluoroethyl ether. A more preferred composition includes (a) about 42 wt. % of 1,2-trans-dichloroethylene, (b) about 54 wt. % of 1,1,1,3,3 pentafluorobutane, and (c) about 4 wt. % of 1,1,2,2 tetrafluorethyl-2,2,2-trifluoroethyl ether. All disclosed weight per cents specified herein are based on the total weight of the composition.

Azeotrope-Like Compositions B

Azeotrope-like compositions exhibiting the constant boiling point at 760 mm Hg of about 34° C. to about 36° C. include (a) about 27 wt. % to about 34 wt. % of 1,2-trans-dichloroethylene, (b) about 59 wt. % to about 71 wt. % of 1,1,1,3,3 pentafluorobutane, (c) about 0.5 wt. % to about 4 wt. % of 1,1,2,2 tetrafluorethyl-2,2,2-trifluoroethyl ether, and (d) about 0.5 wt. % to about 4 wt. % of methanol. Preferably these compositions include (a) about 30 wt. % to about 34 wt. % of 1,2-trans-dichloroethylene, (b) about 63 wt. % to about 67 wt. % of 1,1,1,3,3 pentafluorobutane, (c) about 1 wt. % to about 3 wt. % of 1,1,2,2 tetrafluorethyl-2,2,2-trifluoroethyl ether, and (d) about 1 wt. % to about 2 wt. % of methanol. A more preferred composition includes (a) about 32 wt. % of 1,2-trans-dichloroethylene, (b) about 65 wt. % of 1,1,1,3,3 pentafluorobutane, (c) about 2 wt. % of 1,1,2,2 tetrafluorethyl-2,2,2-trifluoroethyl ether, and (d) about 1 wt. % methanol.

The following examples are provided to illustrate the invention, but are not intended to limit the scope thereof. Example 1 reports a conventional formulation, not in accordance with the invention. In contrast, Examples 2 through 5 describe formulations according to aspects of the disclosed invention.

Example 1 (Comparative Example)

A simple distillation was performed on a solvent mixture commercially available under the tradename Solvex HD from Banner Chemicals Group UK (Cheshire, United Kingdom). This product may also be described in European patent publication No. 2,746,380 A1. This solvent mixture ("Formulation 1") is understood to be a blend of a 1,2-trans-dichloroethylene, ethoxy-nonafluorobutane (HFE 7200), and 1,1,1,3,3-pentafluorobutane (HFC-365 mfc). The distillation was performed to determine the change in concentration of these formulation constituents during boiling as distillation cuts are removed.

As the initial charge, 400 grams (g) (319 milliliters (mL)) of the Solvex HD mixture was weighed out on a laboratory balance. This was then poured into a 500 mL three-neck round bottom flask. A small stir rod was placed in the flask and the flask was connected to a simple distillation setup. A 500 mL hemispheric heating mantle was placed under the pot with a stir plate directly below that.

The heating mantle was connected to a standard variable autotransformer (variac) to maintain constant temperature to the heating mantle and three temperature probes were setup on the system to measure (in ° C.) the temperature: one in the liquid, one in the vapor layer in the flask, and one at the top (overheads) of the simple distillation setup before the vapor enters the condenser.

The variac was initially turned to 30 to obtain the first six distillation cuts. As the temperature of the liquid in the flask increased, the flow of sample through the simple distillation setup slowed, and the variac was raised to 33 to ensure a near consistent sampling rate.

Sampling was done at approximately every 25 mL for the first 9 distillation cuts. The last distillation cut (cut #10) was larger because the power to the heating mantle was turned off when 25 mL had been removed but the contents of the pot continued to boil creating more liquid in the final cut.

The cuts were then run on a Gas Chromatogram (GC) to give weight per cents (wt. %) of the constituents.

The data are summarized in Table 1, below.

TABLE 1

| Cut | ml | g | Vol. % Removed | Liquid B.P. ° C. | Top B.P. ° C. | 1,2-trans-dichloroethylene (Wt. %) | ethoxy-nonafluorobutane (Wt. %) | 1,1,1,3,3-pentafluorobutane (Wt. %) |
|---|---|---|---|---|---|---|---|---|
| 0 | 0 | 0 | 0 | | | 78.69 | 6.78 | 14.53 |
| 1 | 25 | 31.7 | 7.9 | 41.1 | 37.1 | 51.92 | 6.46 | 41.62 |
| 2 | 24 | 30.6 | 15.6 | 41.6 | 38.8 | 57.86 | 7.99 | 34.15 |
| 3 | 25 | 31.3 | 23.4 | 43.2 | 38.9 | 60.65 | 8.71 | 30.64 |
| 4 | 24 | 30.4 | 31.0 | 44.2 | 42.1 | 64.24 | 9.62 | 26.14 |
| 5 | 24 | 29.7 | 38.4 | 45.6 | 42.9 | 71.76 | 10.70 | 17.54 |
| 6 | 24 | 30.1 | 46.0 | 46.7 | 43.7 | 79.05 | 11.01 | 9.94 |
| 7 | 25 | 31.4 | 53.8 | 47.1 | 44.9 | 85.79 | 10.04 | 4.18 |
| 8 | 25 | 31.8 | 61.8 | 47.5 | 45.4 | 90.98 | 7.81 | 1.21 |
| 9 | 25 | 31.7 | 69.7 | 47.2 | 46.1 | 95.82 | 4.03 | 0.15 |
| 10 | 35 | 42.2 | 80.2 | 48 | 46.2 | 98.86 | 1.13 | 0.01 |
| Bottoms | 62 | 78.4 | 99.8 | | | 99.84 | 0.16 | 0.00 |

One disadvantage of this mixture, Formulation 1, is that the components will partition as the material is lost to evaporation. FIG. 1 shows the results of this partitioning. Specifically, FIG. 1 shows a plot of the volume percent of the mixture removed (X-axis) and the vapor concentrations (in weight per cents) of each of the three formulation components (Y-axis) in those cuts.

As seen in FIG. 1 the solvent mixture, Formulation 1, starts at about 79 wt. % 1,2-trans-dichloroethylene, 7 wt. % ethoxy-nonafluorobutane, and 14 wt. % 1,1,1,3,3-pentafluorobutane. The vapor concentration has no stable point and begins to fall apart almost immediately with product removal. With 8% of the liquid evaporated, the vapor phase contains 52 wt. % 1,2-trans-dichloroethylene, 6 wt. % ethoxy-nonafluorobutane and an excessively high value of 42 wt. % 1,1,1,3,3-pentafluorobutane.

As a result of this partitioning with half of the material distilled out, the 1,2-trans-dichloroethylene concentration reaches about 85 wt. %. This leaves only about 15 wt. % of ethoxy-nonafluorobutane and 1,1,1,3,3-pentafluorobutane remaining in the solvent mix, about a 30% reduction. This reduction can have a detrimental effect on cleaning characteristics as well as create a safety hazard due to increased flammability of the solvent blend.

A second way to determine the stability of a solvent mixture is by monitoring the boiling point of the distillation. If the boiling point remains constant the solvent mixture tends to be constant. The boiling point of the mixture (Formulation 1) in this example (see Table 1) had an excessively large range of 41° C. to 48° C. throughout the course of the distillation.

Example 2

The distillation explained in Example 1 was carried out with three formulations according to the invention, Formulations 2, 3, and 4, and the data collected from the distillation analyses of each are reported in Tables 2, 3, and 4, below, and in FIGS. 2, 3, and 4, respectively.

TABLE 2

| Cut | ml | g | Vol. % Removed | Liquid B.P. ° C. | Top B.P. ° C. | 1,2-trans-dichloroethylene (Wt. %) | 1,1,2,2-tetrafluoroethyl-2,2,2-trifluoroethyl ether (Wt. %) | 1,1,1,3,3-pentafluorobutane (Wt. %) |
|---|---|---|---|---|---|---|---|---|
| 0 | 0 | 0 | 0 | | | 41.68 | 3.82 | 54.5 |
| 1 | 25 | 31.8 | 8.5 | 35.9 | 33.6 | 36 | 2.12 | 61.89 |
| 2 | 25 | 31.2 | 16.8 | 36.4 | 34 | 36.407 | 2.32 | 61.27 |
| 3 | 25 | 31.2 | 25.1 | 36.5 | 34 | 36.563 | 2.49 | 60.95 |
| 4 | 25 | 31.1 | 33.4 | 36.7 | 34 | 36.77 | 2.61 | 60.61 |
| 5 | 25 | 31.7 | 41.9 | 36.6 | 33.8 | 37.091 | 2.80 | 60.11 |
| 6 | 25 | 33.3 | 50.7 | 37.2 | 34.2 | 37.541 | 3.09 | 59.37 |
| 7 | 26 | 31.5 | 59.1 | 37.6 | 34.8 | 38.497 | 3.64 | 57.86 |
| 8 | 25 | 33.2 | 68.0 | 37.6 | 35 | 39.98 | 4.63 | 55.39 |
| 9 | 26 | 31.7 | 76.5 | 38.9 | 35.4 | 43.22 | 6.78 | 50.00 |
| 10 | 30 | 43.6 | 88.1 | 44.4 | 36.1 | 51.849 | 10.68 | 37.47 |
| Bottoms | 30 | 43.9 | 99.8 | | | 94.25 | 2.35 | 3.4 |

The initial charge to the distillation apparatus was 375 grams (289 milliliters) of the mixture. The boiling point range of this mixture z was about 33° C. to about 36° C., a range typical of azeotropic blends.

TABLE 3

| Cut | ml | g | Vol. % Removed | Liquid B.P. ° C. | Top B.P. ° C. | 1,2-trans-dichloroethylene (Wt. %) | 1,1,2,2-tetrafluoroethyl-2,2,2-trifluoroethyl ether (Wt. %) | 1,1,1,3,3-pentafluorobutane (Wt. %) |
|---|---|---|---|---|---|---|---|---|
| 0 | 0 | 0 | 0 | | | 52.3 | 2.8 | 44.9 |
| 1 | 25 | 31.6 | 8.3 | 35.0 | 34.1 | 39.36 | 2.05 | 58.59 |
| 2 | 24 | 31.3 | 16.6 | 35.3 | 34.5 | 39.71 | 2.19 | 58.1 |
| 3 | 25 | 31.7 | 24.9 | 35.4 | 34.5 | 40.45 | 2.37 | 57.18 |
| 4 | 24 | 30.9 | 33.0 | 35.6 | 34.8 | 40.79 | 2.5 | 56.71 |
| 5 | 26 | 32.4 | 41.6 | 35.9 | 34.9 | 41.59 | 2.78 | 55.63 |
| 6 | 26 | 32.1 | 50.0 | 36.4 | 35.2 | 42.31 | 2.97 | 54.72 |
| 7 | 25 | 31.6 | 58.3 | 36.8 | 35.4 | 43.5 | 3.32 | 53.18 |
| 8 | 25 | 31.5 | 66.6 | 37.5 | 35.9 | 45.09 | 3.79 | 51.12 |
| 9 | 30 | 43.4 | 78.0 | 38.9 | 36.7 | 48.21 | 4.5 | 47.29 |
| 10 | 30 | 43.7 | 89.5 | 42.4 | 39.5 | 73.9 | 4.81 | 21.29 |
| Bottoms | 27 | 33.8 | 98.4 | | | 96.66 | 0.65 | 2.69 |

The initial charge to the distillation apparatus was 380 grams (291 milliliters) of the mixture. The boiling point range of this mixture was about 34° C. to about 40° C., slightly larger than the range for the mixture reported in Table 2, but it still outperforms the mixture described in Table 1.

TABLE 4

| Cut | ml | g | Vol. % Removed | Liquid B.P. ° C. | Top B.P. ° C. | 1,2-trans-dichloroethylene (Wt. %) | 1,1,2,2-tetrafluoroethyl-2,2,2-trifluoroethyl ether (Wt. %) | 1,1,1,3,3-pentafluorobutane (Wt. %) |
|---|---|---|---|---|---|---|---|---|
| 0 | 0 | 0 | 0 | | | 45.5 | 3.25 | 51.25 |
| 1 | 25 | 31.8 | 10.6 | 35.2 | 33.8 | 37.31 | 1.96 | 60.73 |
| 2 | 25 | 31.1 | 21.0 | 35.6 | 34.2 | 37.92 | 2.19 | 59.89 |
| 3 | 24 | 31.8 | 31.6 | 35.7 | 34.3 | 38.28 | 2.4 | 59.32 |
| 4 | 25 | 31.8 | 42.2 | 35.9 | 34.5 | 38.93 | 2.67 | 58.39 |
| 5 | 25 | 31.7 | 52.7 | 36.5 | 34.9 | 39.66 | 3.01 | 57.33 |
| 6 | 25 | 34.2 | 64.1 | 37.3 | 35.3 | 40.75 | 3.48 | 55.77 |
| 7 | 27 | 31.9 | 74.8 | 39.3 | 36.7 | 42.55 | 4.23 | 53.22 |
| 8 | 25 | 31.7 | 85.3 | 43.5 | 40.3 | 45.65 | 5.59 | 48.76 |
| Bottoms | 28 | 38.1 | 98.0 | | | 93.21 | 1.7 | 5.02 |

The initial charge to the distillation apparatus was 300 grams (231 milliliters) of the mixture. The boiling point range of this mixture was about 34° C. to about 40° C., slightly larger than the range for the mixture reported in Table 2, but it still outperforms the mixture described in Table 1.

Figure 2:
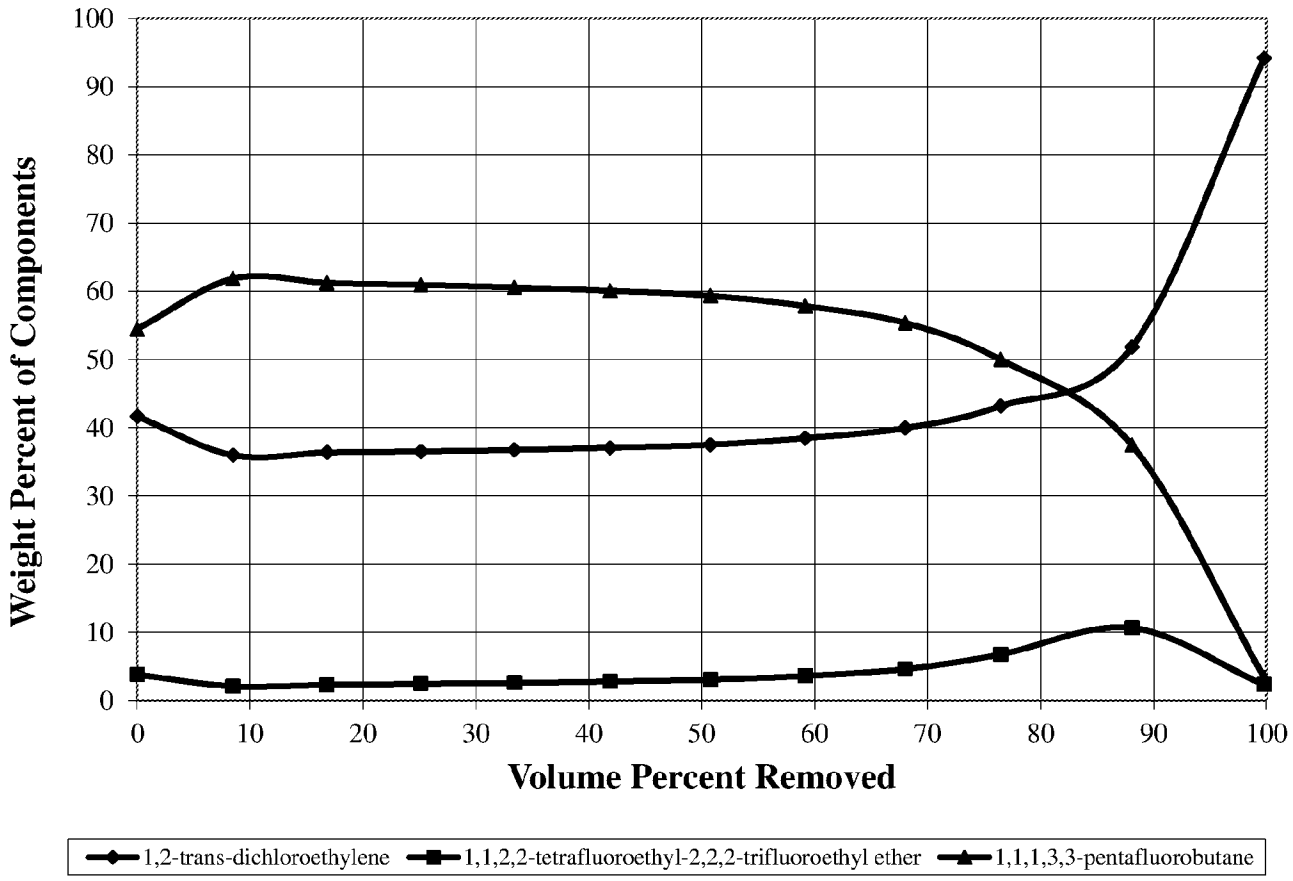
FIG. 2 is a plot of distillation cuts of a formulation according to an aspect of the disclosed invention and the concentrations of each of the formulation components in those cuts.
Figure 3:
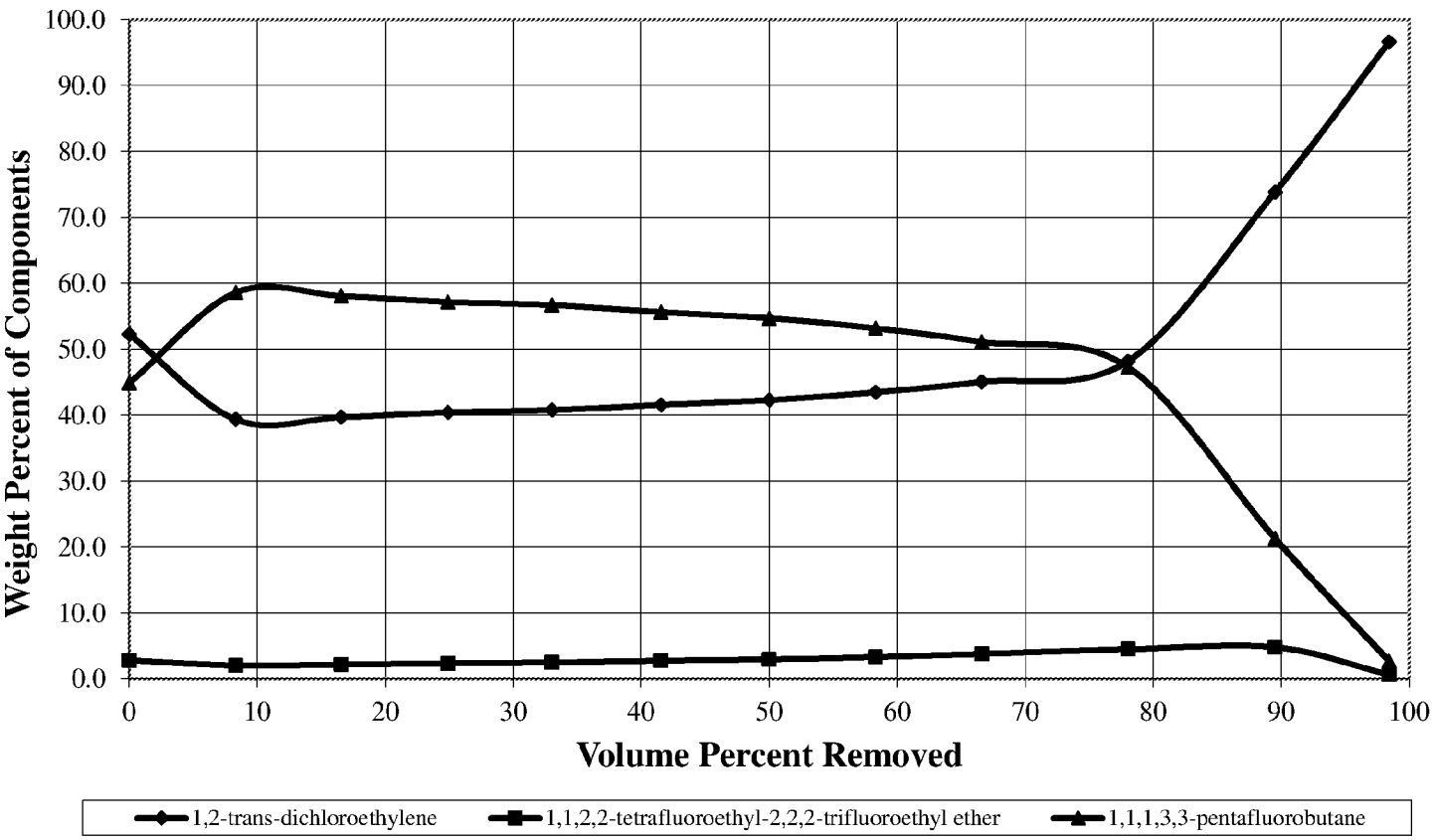
FIG. 3 is a plot of distillation cuts of a formulation according to an aspect of the disclosed invention and the concentrations of each of the formulation components in those cuts.
Figure 4:
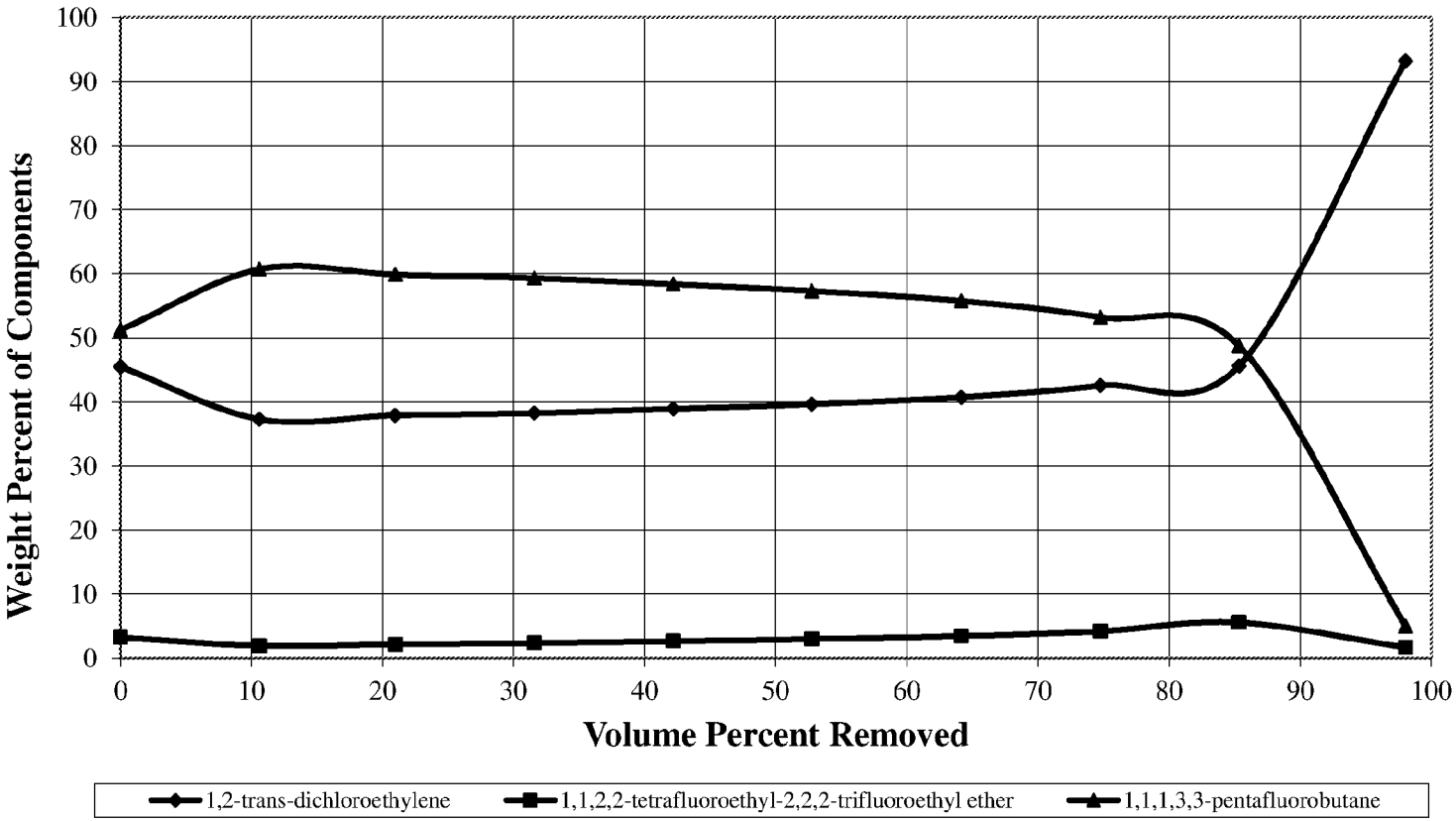
FIG. 4 is a plot of distillation cuts of a formulation according to an aspect of the disclosed invention and the concentrations of each of the formulation components in those cuts.

The data reported in Tables 2, 3, and 4, are graphically shown in FIGS. 2, 3, and 4, respectively. Each shows a plot of the distillation cuts (X-axis) and the concentrations of each of the three formulation components (Y-axis) in those cuts.

As seen in FIGS. 2 through 4, the concentrations of the components of the distilled mixtures remain relatively consistent until over 75% of each mixture was removed. In FIG. 4, it can be seen that the concentrations of the components of the distilled mixture (one containing a higher amount of 1,2-trans-dichloroethylene relative to the original mixture described in Table 2 but a lower amount relative to the original mixture described in Table 3) remain relatively consistent until over 85% of the mixture was removed.

Another interesting characteristic with solvent blends of the invention is that the three-component blend described in Tables 2 through 4 is also "azeotrope-like" with a fourth component being methanol. Methanol is beneficial in certain solvent blends in that its high polarity allows the solvent to remove various ionic components. The non-polar nature of most solvents make them effective in removing oils and greases but will leave residues when cleaning fluxes. The addition of methanol eliminates this problem.

The distillation explained in Example 1 was carried out with a formulation according to the invention that includes methanol as a fourth component. The formulation and distillation are described in further details in Table 5 and FIG. 5.

TABLE 5

| Cut | ml | g | Vol. % Removed | Liquid B.P. ° C. | Top B.P. ° C. | 1,2-trans-dichloroethylene (Wt. %) | 1,1,2,2-tetrafluoroethyl-2,2,2-trifluoroethyl ether (Wt. %) | 1,1,1,3,3-pentafluorobutane (Wt. %) | Methanol (Wt. %) |
|---|---|---|---|---|---|---|---|---|---|
| 0 | 0 | 0 | 0 | | | 39.73 | 9.98 | 45.29 | 4.991309 |
| 1 | 25 | 31.8 | 6.8 | 36.0 | 33.4 | 31.70 | 2.02 | 64.90 | 1.392 |
| 2 | 25 | 31.9 | 13.7 | 36.0 | 33.6 | 31.86 | 2.00 | 64.72 | 1.43 |

TABLE 5-continued

| Cut | ml | g | Vol. % Removed | Liquid B.P. ° C. | Top B.P. ° C. | 1,2-trans-dichloroethylene (Wt. %) | 1,1,2,2-tetrafluoroethyl-2,2,2-trifluoroethyl ether (Wt. %) | 1,1,1,3,3-pentafluorobutane (Wt. %) | Methanol (Wt. %) |
|---|---|---|---|---|---|---|---|---|---|
| 3 | 25 | 31.4 | 20.5 | 36.2 | 33.7 | 31.86 | 2.01 | 64.71 | 1.426 |
| 4 | 25 | 31.6 | 27.4 | 36.3 | 33.9 | 31.95 | 2.03 | 64.59 | 1.43 |
| 5 | 25 | 31.8 | 34.2 | 36.5 | 34 | 32.23 | 2.15 | 64.19 | 1.435 |
| 6 | 25 | 31.7 | 41.1 | 36.6 | 34.2 | 31.89 | 2.05 | 64.64 | 1.422 |
| 7 | 25 | 31.5 | 47.9 | 37.0 | 34.3 | 35.18 | 3.74 | 59.58 | 1.498 |
| 8 | 25 | 31.7 | 54.8 | 37.3 | 34.9 | 48.94 | 14.67 | 34.50 | 1.896 |
| 9 | 25 | 31.8 | 61.6 | 37.8 | 35.1 | 62.44 | 28.43 | 6.80 | 2.327 |
| 10 | 25 | 31.9 | 68.5 | 38.6 | 35.3 | 74.82 | 16.33 | 0.39 | 6.121 |
| Bottoms | 103 | 121.3 | 96.7 | | | 74.82 | 16.33 | 0.39 | 6.121 |

Figure 5:
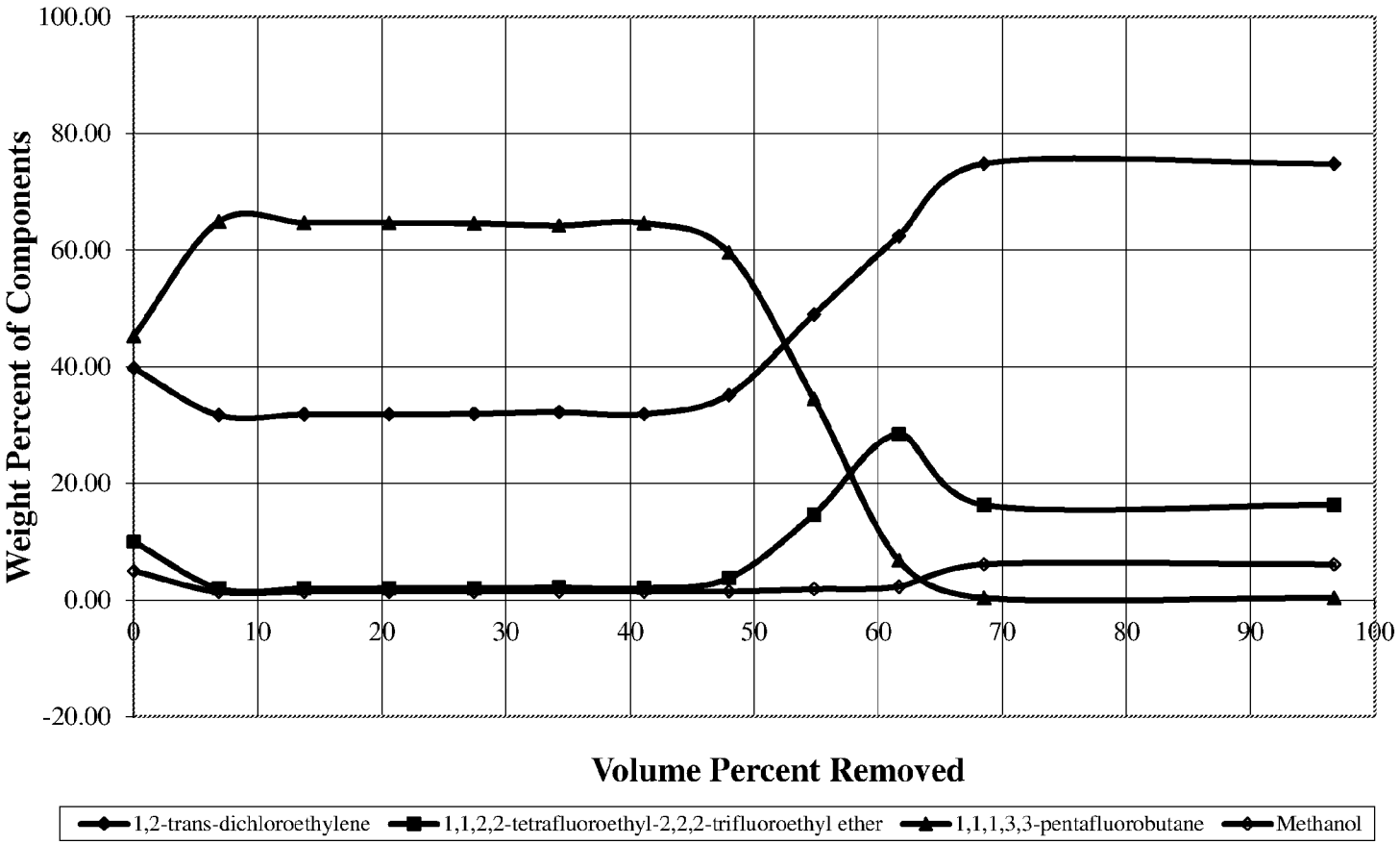
FIG. 5 is a plot of distillation cuts of a formulation according to an aspect of the disclosed invention and the concentrations of each of the formulation components in those cuts.

The initial charge to the distillation apparatus was 442.8 grams (365 milliliters) of the mixture. The boiling point range of this mixture was about 33° C. to about 35° C. The data reported in Table 5 are graphically shown in FIG. 5. FIG. 5 shows a plot of the distillation cuts (X-axis) and the concentrations of each of the four formulation components (Y-axis) in those cuts. The vapor concentration holds consistent until about 55% of the material is removed. Although this may not be as desirably high as that observed for the formulations described in Tables 2, 3, and 4, it still performs significantly better than the formulation described in Table 1 (Example 1).

Example 3 (Comparative Example)

A simple distillation was performed with two additional formulations—neither of which is a formulation according to the invention—to determine the change in concentration of these formulation constituents during boiling as distillation cuts are removed.

The first of the two formulations here contained only two substances: 79.8 wt. % 1,1,2,2-tetrafluoroethyl-2,2,2-trifluoroethyl ether, and 20.2 wt. % methanol. This formulation is referred to hereinafter as "Formulation 6." Formulation 6 is of a type generally exemplified in U.S. Pat. No. 7,527,697. The second of the two formulations here contained only three substances: 80 wt. % 1,2-trans-dichloroethylene, 16 wt. % 1,1,2,2-tetrafluoroethyl-2,2,2-trifluoroethyl ether, and 4 wt. % methanol. This formulation is referred to hereinafter as "Formulation 7." Formulation 7 is of a type generally described in U.S. Pat. No. 7,163,645.

Each of Formulations 6 and 7 was subject to distillation according to an apparatus that is generally the same as the one described in Example 1, but with certain modifications. First, the volume of the three-neck round bottom flask here was 1000 mL (versus 500 mL). Instead of a 500 mL hemispheric heating mantle, this apparatus used a 1000 mL hemispheric heating mantle and the heat applied was controlled by a computer to ensure a near consistent sampling rate. Sampling occurred at every 70 or 80 mL for nearly all cuts. Any deviations are indicated in Tables 6 and 7, below, which otherwise summarize the data. Each cut was then run on a Gas Chromatogram (GC) to give weight per cents of the formulation constituents.

Figure 6:
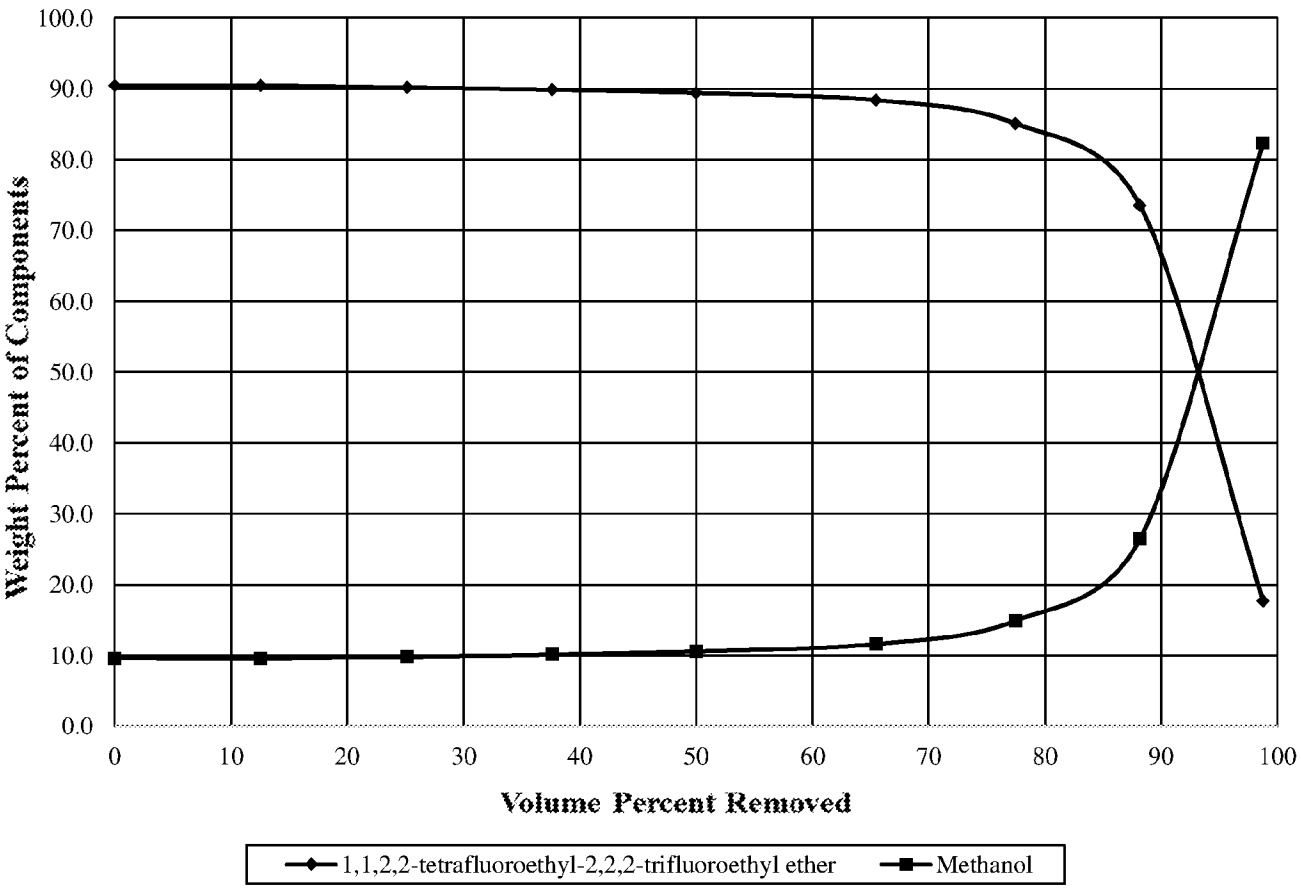
FIG. 6 is a plot of distillation cuts of a comparative formulation (not in accordance with the disclosed invention) and the concentrations of each of the formulation components in those cuts; and, FIG. 7 is a plot of distillation cuts of a comparative formulation (not in accordance with the disclosed invention) and the concentrations of each of the formulation components in those cuts.

The data regarding the distillation of Formulation 6 are reported in Table 6 and FIG. 6. The initial charge to the distillation apparatus was 882.5 grams (700 ml) of the mixture, Formulation 6. The boiling point range of Formulation 6 was about 50° C. to about 64° C., and the concentration of the two substances remained constant in the vapor and liquid phases until about 70% of the mixture was removed. While these are characteristics of an azeotrope-like mixture, Formulation 6 differs from the example formulations according to the invention (i.e., Formulations 2, 3, 4, and 5) because it contains only two substances, and does not include either of 1,2-trans-dichloroethylene or 1,1,1,3,3-pentaflourobutane.

Figure 7:
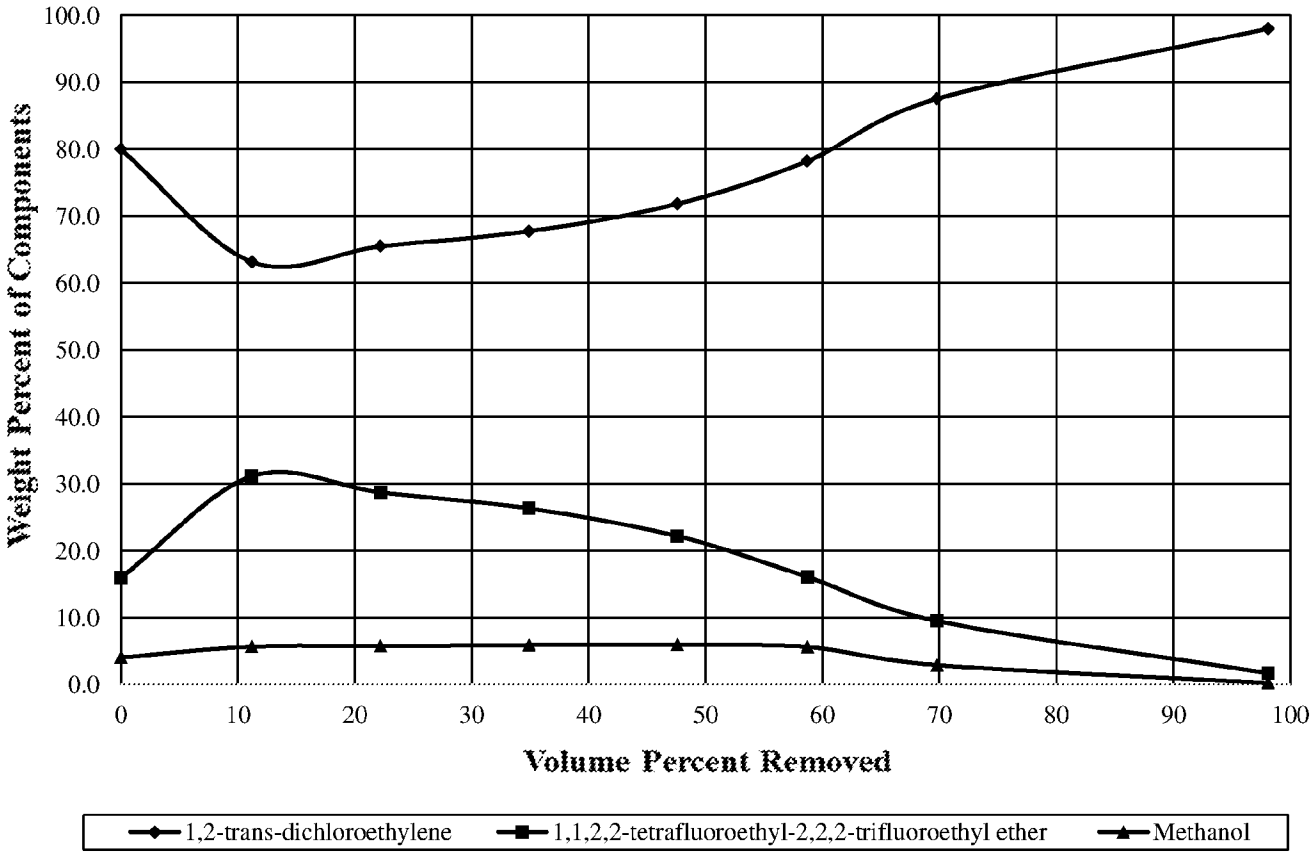

The data regarding the distillation of Formulation 7 are reported in Table 7 and FIG. 7. The initial charge to the distillation apparatus was 779.5 grams (623 ml) of the mixture, Formulation 7. The boiling point range of Formulation 7 was about 38° C. to about 48° C. Like Formulation 1 (Example 1), Formulation 7 suffers the disadvantage that the constituents partition as the formulation evaporates. FIG. 7 shows the results of this partitioning. Formulation 7 starts at about 80% 1,2-trans-dichloroethylene, 16 wt. % 1,1,2,2-tetrafluoroethyl-2,2,2-trifluoroethyl ether, and 4 wt. % methanol. The vapor concentration has no stable point and begins to fall apart almost immediately with product removal. With 10% of the liquid evaporated, the vapor phase contains about 72% 1,2-trans-dichloroethylene, 32 wt. % 1,1,2,2-tetrafluoroethyl-2,2,2-trifluoroethyl ether, and 6 wt. % methanol. These deviations (including those shown in FIG. 7) can have a detrimental effect on cleaning characteristics as well as create a safety hazard due to increased flammability of the solvent blend.

TABLE 6

| Cut | ml | g | Vol. % Removed | Liquid B.P. ° C. | Top B.P. ° C. | 1,1,2,2-tetrafluoroethyl-2,2,2-trifluoroethyl ether (Wt. %) | Methanol (Wt. %) |
|---|---|---|---|---|---|---|---|
| 0 | 0 | 0 | 0 | 52.4 | 50 | 90.4 | 9.6 |
| 1 | 80 | 110.8 | 12.6 | 52.9 | 50.6 | 90.2 | 9.8 |
| 2 | 81 | 111.2 | 25.2 | 53.2 | 50.7 | 89.9 | 10.1 |
| 3 | 80 | 110.3 | 37.7 | 53.4 | 50.8 | 89.4 | 10.6 |
| 4 | 80 | 109.1 | 50.0 | 54.1 | 51.2 | 88.4 | 11.6 |
| 5 | 100 | 136.4 | 65.5 | 55.9 | 52.5 | 85.1 | 14.9 |
| 6 | 80 | 105.6 | 77.4 | 58.8 | 55.4 | 73.5 | 26.5 |
| 7 | 79 | 94.7 | 88.2 | 64 | 61.2 | 17.7 | 82.3 |
| Bottoms | 110 | 93.3 | 98.7 | | | | |

TABLE 7

| Cut | ml | g | Vol. % Removed | Liquid B.P. ° C. | Top B.P. ° C. | 1,2-trans-dichloroethylene (Wt. %) | 1,1,2,2-tetrafluoroethyl-2,2,2-trifluoroethyl ether (Wt. %) | Methanol (Wt. %) |
|---|---|---|---|---|---|---|---|---|
| 0 | 0 | 0 | 0 | 14 | 22 | 80.0 | 16.0 | 4.1 |
| 1 | 70 | 87.4 | 11.2 | 41.6 | 39.1 | 63.2 | 31.1 | 5.7 |
| 2 | 69 | 85.7 | 22.2 | 41.5 | 39.3 | 65.5 | 28.7 | 5.8 |
| 3 | 80 | 98.9 | 34.9 | 42.4 | 39.6 | 67.8 | 26.3 | 5.9 |
| 4 | 80 | 99.2 | 47.6 | 43.8 | 40.3 | 71.9 | 22.2 | 6.0 |
| 5 | 70 | 86.4 | 58.7 | 44.9 | 42.9 | 78.3 | 16.1 | 5.6 |
| 6 | 70 | 86.5 | 69.8 | 47.8 | 45.1 | 87.6 | 9.5 | 2.9 |
| Bottoms | 180.7 | 220.7 | 98.1 | | | 98.0 | 1.7 | 0.2 |

The foregoing description is given for clearness of understanding only, and no unnecessary limitations should be understood therefrom, as modifications within the scope of the invention may be apparent to those having ordinary skill in the art.

What is claimed is:

1. An azeotrope-like composition comprising (a) 1,2-trans-dichloroethylene, (b) 1,1,1,3,3-pentafluorobutane, and (c) 1,1,2,2-tetrafluoroethyl-2,2,2-trifluoroethyl ether.

2. The azeotrope-like composition of claim 1, further comprising (d) a component selected from the group consisting of alcohol, ether, ketone, alkane, alkene, and mixtures thereof.

3. The azeotrope-like composition of claim 2, wherein the component is an alcohol and the alcohol is methanol.

4. The azeotrope-like composition of claim 2, wherein the component is an alkane and the alkane is a halogenated alkane.

5. The azeotrope-like composition of claim 2, wherein the component is an alkane and the alkane is a cycloalkane.

6. The azeotrope-like composition of claim 2, wherein the component is an alkene and the alkene is a halogenated alkene.

7. The azeotrope-like composition of claim 1 comprising (a) about 37 wt. % to about 47 wt. % of 1,2-trans-dichloroethylene, (b) about 51 wt. % to about 61 wt. % of 1,1,1,3,3 pentafluorobutane, and (c) about 1 wt. % to about 8 wt. % of 1,1,2,2 tetrafluorethyl-2,2,2-trifluoroethyl ether, wherein the composition has a constant boiling point at 760 mm Hg of about 34° C. to about 36° C.

8. The azeotrope-like composition of claim 7 comprising (a) about 40 wt. % to about 44 wt. % of 1,2-trans-dichloroethylene, (b) about 54 wt. % to about 57 wt. % of 1,1,1,3,3 pentafluorobutane, and (c) about 2 wt. % to about 6 wt. % of 1,1,2,2 tetrafluorethyl-2,2,2-trifluoroethyl ether.

9. The azeotrope-like composition of claim 8 comprising (a) about 42 wt. % of 1,2-trans-dichloroethylene, (b) about 54 wt. % of 1,1,1,3,3 pentafluorobutane, and (c) about 4 wt. % of 1,1,2,2 tetrafluorethyl-2,2,2-trifluoroethyl ether.

10. The azeotrope-like composition of claim 3 comprising (a) about 27 wt. % to about 34 wt. % of 1,2-trans-dichloroethylene, (b) about 59 wt. % to about 71 wt. % of 1,1,1,3,3 pentafluorobutane, (c) about 0.5 wt. % to about 4 wt. % of 1,1,2,2 tetrafluorethyl-2,2,2-trifluoroethyl ether, and (d) about 0.5 wt. % to about 4 wt. % of methanol, wherein the composition has a constant boiling point at 760 mm Hg of about 34° C. to about 36° C.

11. The azeotrope-like composition of claim 10 comprising (a) about 30 wt. % to about 34 wt. % of 1,2-trans-dichloroethylene, (b) about 63 wt. % to about 67 wt. % of 1,1,1,3,3 pentafluorobutane, (c) about 1 wt. % to about 3 wt. % of 1,1,2,2 tetrafluorethyl-2,2,2-trifluoroethyl ether, and (d) about 1 wt. % to about 2 wt. % of methanol.

12. The azeotrope-like composition of claim 11 comprising (a) about 32 wt. % of 1,2-trans-dichloroethylene, (b) about 65 wt. % of 1,1,1,3,3 pentafluorobutane, (c) about 2 wt. % of 1,1,2,2 tetrafluorethyl-2,2,2-trifluoroethyl ether, and (d) about 1 wt. % methanol.

* * * * *